US005476030A

United States Patent [19]

Plettner

[11] Patent Number: 5,476,030

[45] Date of Patent: Dec. 19, 1995

[54] HYDRAULIC DEVICE FOR A HYDRAULIC DRIVE FOR A HIGH-TENSION CIRCUIT-BREAKER

[75] Inventor: Horst Plettner, Hanau, Germany

[73] Assignee: ABB Patent GmbH, Mannheim, Germany

[21] Appl. No.: 328,070

[22] Filed: Oct. 24, 1994

[30] Foreign Application Priority Data

Oct. 22, 1993 [DE] Germany ..... 43 36 074.2

[51] Int. Cl.[6] ..... F15B 21/02

[52] U.S. Cl. ..... 91/38; 91/417 R

[58] Field of Search ..... 60/394; 91/38, 91/417 R; 251/48

[56] References Cited

U.S. PATENT DOCUMENTS 3,012,541 12/1961 Meulendyk et al. ..... 91/38
3,451,414 6/1969 Buford et al. ..... 137/624.14
3,656,404 4/1972 Landenzon et al. ..... 91/38
3,863,547 2/1975 Meier et al. ..... 91/416
3,896,852 7/1975 Holmes ..... 91/38

*Primary Examiner*—F. Daniel Lopez
*Attorney, Agent, or Firm*—Herbert L. Lerner; Laurence A. Greenberg

[57] ABSTRACT

A hydraulic device for a hydraulic drive for a high-voltage circuit-breaker includes a drive piston for a movable contact piece having two piston sides being in connection with a high-pressure reservoir in a closed condition and being acted upon by high-pressure fluid on both sides. For circuit-breaking, a switch-over valve releases a path to a low-pressure space for the fluid in the space with the larger piston area. At least one circuit-closing pilot valve and circuit-breaking pilot valve activate the switch-over valve. A settable delay volume for the fluid is connected in parallel with at least the at least one circuit-breaking pilot valve.

8 Claims, 1 Drawing Sheet

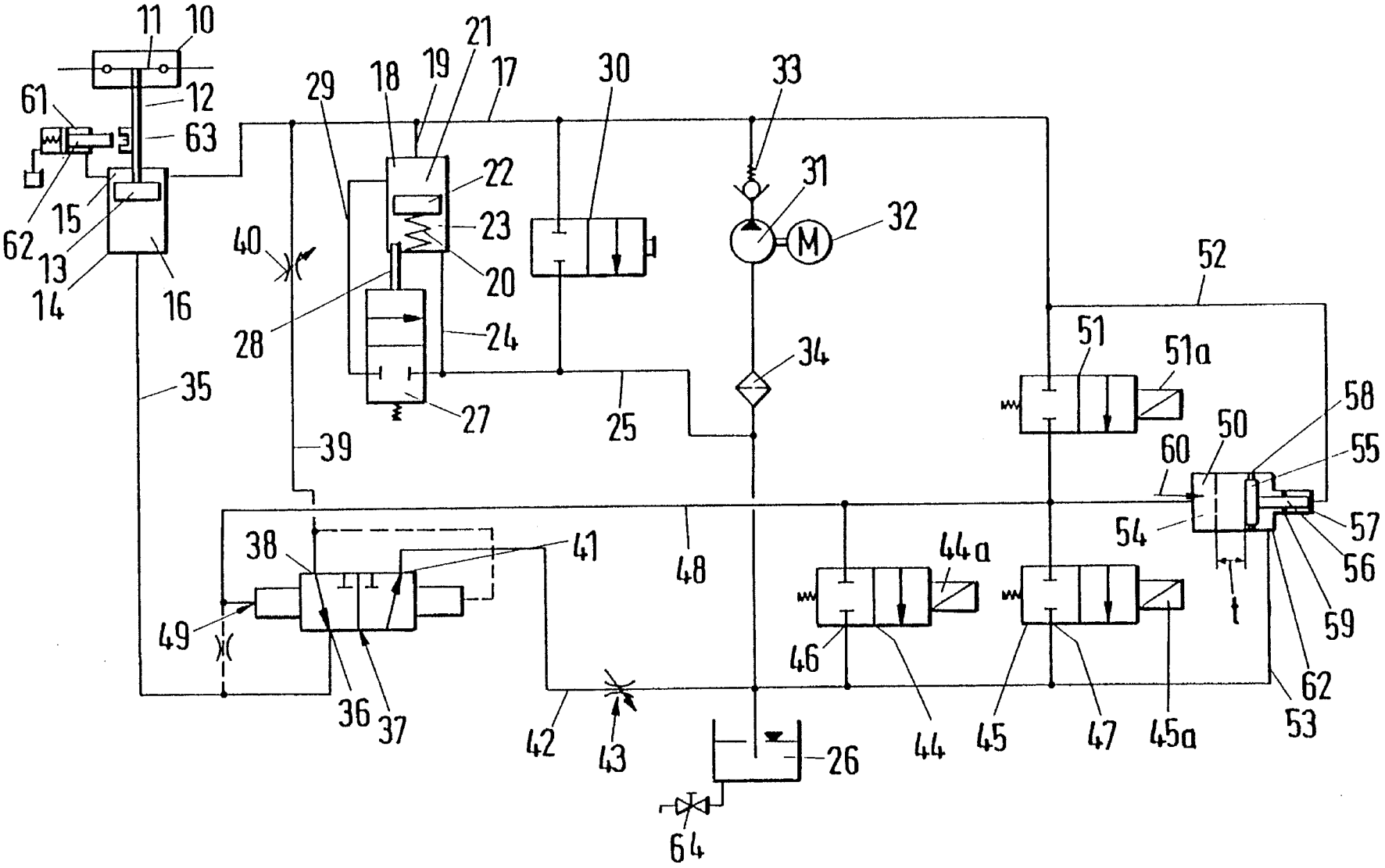
58
55
57
56
59
62
53
52
50
51a
60
54
45a
51
47
45
44a
44
32
31
33
34
46
26
64
48
30
25
43
42
41
17
22
23
20
24
27
21
19
18
29
28
39
37
36
38
40
49
10
12
63
16
35
11
15
13
14
61
62

HYDRAULIC DEVICE FOR A HYDRAULIC DRIVE FOR A HIGH-TENSION CIRCUIT-BREAKER

BACKGROUND OF THE INVENTION

1. Field of the Invention

The invention relates to a hydraulic device for a hydraulic drive for a high-voltage or high-tension circuit-breaker, including a drive piston for a movable contact piece having two piston sides being in connection with a high-pressure reservoir in a closed condition and being acted upon by high-pressure fluid on both sides, a switch-over valve releasing a path to the low-pressure space for the fluid in the space with the larger piston area, for the purpose of circuit-breaking, and at least one circuit-closing pilot valve and circuit-breaking pilot valve for activating the switch-over valve.

The movable contact piece of a high-voltage circuit-breaker, in particular an $SF_6$ gas-isolated circuit-breaker, is connected to the drive piston of a drive piston cylinder configuration. The drive piston is actuated by a hydraulic configuration for opening and closing the circuit-breaker. For that purpose, the two spaces on either side of the working piston are acted upon by a fluid at high pressure. The pressure is provided by a hydraulic reservoir which can be configured as a gas reservoir or a spring reservoir. The piston area in the first space is larger than that in the second space because the piston rod is connected to the piston in the latter space. Both spaces of the drive piston and cylinder configuration are connected to a switch-over valve which releases a path for the high-pressure hydraulic fluid into a low-pressure volume.

The switch-over valve is activated hydraulically by means of pilot valves which have to be actuated electromagnetically, with circuit-breaking pilot valves and circuit-closing pilot valves being normally provided to suit the desired switching sequence. An OFF-ON-OFF switching sequence can be achieved with two circuit-breaking pilot valves and one circuit-closing pilot valve.

It is known that high-voltage circuit-breakers can only extinguish the current to be interrupted on transition through zero current. However, where a short-circuit current has to be switched off, a decaying direct current proportion is superimposed on the alternating current proportion and the switching capability of the circuit-breaker becomes greater as the direct current proportion decays.

In some cases, particularly for switch gears in the U.S.A., a delaying electrical relay is connected into the breaker circuit so as to permit an increase in the circuit-breaking power. However, for reliability reasons, circuit-breakers should be opened directly without additional possible fault elements, such as circuit-breaking relays.

SUMMARY OF THE INVENTION

It is accordingly an object of the invention to provide a hydraulic device for a hydraulic drive for a high-voltage circuit-breaker, which overcomes the hereinafore-mentioned disadvantages of the heretofore-known devices of this general type, which has a circuit-breaking delay and in which the circuit-breaker is opened by direct means.

With the foregoing and other objects in view there is provided, in accordance with the invention, in a hydraulic drive for a high-voltage circuit-breaker having a contact piece being movable between open and closed conditions, a drive piston for the movable contact piece having a side with a larger piston area disposed in one space and side with a smaller piston area disposed in another space, a hydraulic device for the hydraulic drive, comprising a high-pressure reservoir being in connection with the two piston sides in the closed condition for acting upon both sides with high-pressure fluid; a low-pressure space; a switch-over valve releasing a path to the low-pressure space for the fluid in the space with the larger piston area for circuit-breaking; at least one circuit-closing pilot valve and circuit-breaking pilot valve for activating the switch-over valve; and a settable delay volume for the fluid being connected in parallel with at least the at least one circuit-breaking pilot valve.

According to the invention, therefore, a delay volume for the fluid is connected in parallel with the at least one circuit-breaking pilot valve. Due to the delay volume, the pressure drop in the conduit between the circuit-breaking pilot valve and the hydraulic control side of the switch-over valve is delayed so that the mechanical circuit-breaking time of the circuit-breaker is lengthened.

In accordance with another feature of the invention, it is, of course, possible to connect the delay volumes of both circuit-breaking pilot valves in parallel so that a delay takes place both with circuit-breaking using the first circuit-breaking pilot valve and with circuit-breaking using the second circuit-breaking pilot valve.

If, in addition, the delay volume is simultaneously connected in parallel with the circuit-closing pilot valve, the delay volume is again filled with hydraulic fluid during the circuit-closing procedure.

It is self-evident that it is possible to set the delay volume so that the delay time is adjustable.

In accordance with a further feature of the invention, the delay volume is located in a piston/cylinder configuration.

In accordance with an added feature of the invention, the piston/cylinder configuration has a piston with a larger piston area bounding a cylinder space and a smaller piston area bounding a connecting space, the pilot valves have inlets and outlets, and the inlets of the circuit-breaking pilot valves and the outlet of the circuit-closing pilot valve are connected to the cylinder space being bounded by the larger piston area.

In accordance with an additional feature of the invention, the inlet of the circuit-closing pilot valve is connected to the connecting space bounding the smaller piston area.

In accordance with yet another feature of the invention, the piston/cylinder configuration includes a compensation space being sealed between the cylinder space bounding the larger piston area and the connecting space bounding the smaller piston area, the compensation space being connected to the low-pressure container.

In accordance with a concomitant feature of the invention, there is provided a contact surface for the piston being associated with the cylinder space, the contact surface being adjustable for adjusting a path traversed by the piston.

Other features which are considered as characteristic for the invention are set forth in the appended claims.

Although the invention is illustrated and described herein as embodied in a hydraulic device for a hydraulic drive for a high-voltage circuit-breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The figure of the drawing is a schematic circuit diagram of an exemplary embodiment of a hydraulic device according to the invention for actuating an electrical switch.

DESCRIPTION OF THE PREFERRED EMBODIMENTS

Referring now to the single figure of the drawing in detail, there is seen an electrical high-voltage circuit-breaker 10, which can be an encapsulated, $SF_6$ gas-isolated high-voltage circuit-breaker, that has a movable contact piece 11 which is connected to a piston rod 12 having a piston 13 which is guided in such a way that it can reciprocate in a piston/cylinder configuration 14.

The piston 13 divides a space or chamber within the piston/cylinder configuration 14 into a first space or chamber 16 and a second space or chamber 15. The second space 15 is located where the piston rod 12 is connected to the piston 13, so that the piston area there is the smaller piston area.

A fluid conduit 17 opens into the second space 15 and a fluid reservoir 18, which is a spring reservoir provided with a spring 20, is connected through a supply conduit 19 to the fluid conduit 17. The spring 20 is located on a side of a reservoir piston 22 facing away from a fluid space or chamber 21. A conduit 24, which opens into a low-pressure conduit 25 that leads to a low-pressure container or fluid sump 26, is connected to a spring space or chamber 23 which accommodates the spring 20. In the space 23, there is an excess pressure valve 27 which releases a path of a conduit 29 when the piston 22 meets a valve control element 28 in the case of an excess pressure. The conduit 29 is connected to the low-pressure conduit 25 through the excess pressure valve 27 so that the excess pressure is reduced to permissible values when the excess pressure valve 27 responds. The conduit 29 opens into the space 21. A pressure drain screw 30 is disposed in parallel with the spring reservoir 18 between the conduit 17 and the conduit 25.

A pump 31, which is driven by a motor 32, is located between the fluid conduit 17 and the low-pressure conduit 25. A non-return valve 33 is located between the pump 31 and the fluid conduit 17 and only permits passage of fluid from the pump 31 into the fluid conduit 17 in order to fill the fluid reservoir 18. A filter configuration 34 is located before the pump 31, as viewed in the flow direction. The pump 31 sucks fluid from the low-pressure container or fluid sump 26.

A further fluid conduit 35, which is connected to a first connection 36 of a switch-over valve 37, opens into the first space 16. A second connection 38 of the switch-over valve 37 is connected to the fluid conduit 17 by means of a third fluid conduit 39. An adjustable throttle 40 is located within the third fluid conduit 39. A low-pressure fluid conduit 42, in which there is a throttle 43 and which leads to the fluid sump 26, is connected to a third connection 41 of the switch-over valve.

First and second circuit-breaking pilot valves 44, 45, having inlets 46 and 47 which are connected in parallel, and having outlets which are connected to a fourth fluid conduit 48, are connected to the low-pressure fluid conduit 42. The outlets of the first and second circuit-breaking pilot valves 44, 45 are connected on one hand to a hydraulic control side 49 of the switchover valve 37, and on the other hand to a delay volume 50. A circuit-closing pilot valve 51, which is also connected to the conduit 48 on one side, has another side which is connected to the fluid conduit 17 that leads towards the space 21 of the reservoir 18. A fifth fluid conduit 52, which is connected to the delay volume 50, is connected between the non-return valve 33 and another inlet of the circuit-closing pilot valve 51. The inlet 47 of the valve 45, like the inlet 46 of the valve 44, is likewise connected to the delay volume 50 through a sixth fluid conduit 53.

The delay volume 50 is in a piston/cylinder configuration having a cylinder space or chamber 54 and a piston 55 which is guided within the space and on which a piston rod 56 is disposed that enters a connecting space or chamber 57. The piston is guided in such a away that it can move within the cylinder space 54 with a peripheral seal 58 fitted between them, and the piston rod is guided in such a way that it can move within the connecting space 57 with a seal 59 fitted between them.

The conduit 52 opens into the connecting space 57, the conduit 53 opens into a compensation space or chamber 62 between the seal 58 and the seal 59, and the conduit 48 opens into the cylinder space 54.

A free path t over which the piston 55 can be moved back and forth within the cylinder space 54 is limited by means of a screw 60 which acts as a stop. The volume content of the delay volume 50 can therefore be set or adjusted so that the delay time of the pressure drop can also be adjusted.

The mode of operation of the configuration is as follows:

With the circuit-breaker closed, as is shown in the figure, the piston 13 of the drive piston/cylinder configuration 14 is located in its upper position in the figure where, if the system is unpressurized, it is held stationary by a locking device 61 having a locking rod 62 which can engage in a groove 63 on the piston rod 12. If the circuit has to be broken, an electromagnet 44*a* or 4*a* of the valve 44 or 45 is excited so that the conduit 48 is connected to the low-pressure container 26. A drain cock 64 is located on the fluid sump 26. The pressure drop generated by these means is slowed down by the fluid quantity located within the cylinder space 54 so that the switching of the switchover valve 37 is delayed to correspond with this slower pressure change. As soon as the valve 37 has been switched over, the space 16 of the working piston/cylinder configuration is relieved through the conduit 35 and the conduit 42, likewise to the low-pressure container. The throttle 43 is used to delay or control the draining of the fluid. Due to a brief activation of an electromagnet system 51*a* of the circuit-closing pilot valve 51, pressure fluid is supplied from the reservoir 18 through the fluid conduit 17 to the hydraulic control side 49 of the switch-over valve 37, and the piston 55 is also moved into the position shown in the figure. The switch-over valve 37 is switched over into the position shown in the figure so that pressure fluid passes from the energy reservoir 18 into the space 16. Due to the resultant pressure force caused by the different piston area, the circuit-breaker 10 is brought into the closed position. In order to break the circuit again, the electromagnet system 44*a* or 45*a* of the second circuit-breaking pilot valve 44 or 45 is actuated briefly so that the hydraulic control side of the switch-over valve 37 is activated. In the same manner, the pressure drop is again slowed down by the delay volume 50 so that the switching of the switchover valve 37 takes place with a delay. Due to this, a path is released to the low-pressure container 26 for the space 16 within the drive piston/cylinder configuration, so that the piston 13, together with the movable contact piece 11, moves into the open position.

If the fluid quantity located within the energy reservoir 18, and therefore the pressure present in it, have fallen below a certain value, the motor 32, which drives the pump 31, is activated so that fluid filtered by the filter 34 is conveyed from the low-pressure container into the reservoir 18 through the non-return valve 33, the conduit 17 and the conduit 19.

I claim:

1. In a hydraulic drive for a high-voltage circuit-breaker having a contact piece being movable between open and closed conditions, a drive piston for the movable contact piece having a side with a larger piston area disposed in one space and side with a smaller piston area disposed in another space, a hydraulic device for the hydraulic drive, comprising:

a high-pressure reservoir being in connection with the two piston sides in the closed condition for acting upon both sides with high-pressure fluid;

a low-pressure space;

a switch-over valve releasing a path to said low-pressure space for the fluid in the space with the larger piston area for circuit-breaking;

at least one circuit-closing pilot valve and circuit-breaking pilot valve for activating said switch-over valve; and a settable delay volume for the fluid being connected in parallel with at least said at least one circuit-breaking pilot valve.

2. The hydraulic device according to claim 1, wherein said delay volume is connected in parallel with said at least one circuit-breaking pilot valve and with said circuit-closing pilot valve.

3. The hydraulic device according to claim 1, including a piston/cylinder configuration in which said delay volume is disposed.

4. The hydraulic device according to claim 3, wherein said piston/cylinder configuration has a piston with a larger piston area bounding a cylinder space and a smaller piston area bounding a connecting space, said pilot valves have inlets and outlets, and said inlets of said circuit-breaking pilot valves and said outlet of said circuit-closing pilot valve are connected to said cylinder space being bounded by said larger piston area.

5. The hydraulic device according to claim 4, wherein said inlet of said circuit-closing pilot valve is connected to said connecting space bounding said smaller piston area.

6. The hydraulic device according to claim 5, wherein said piston/cylinder configuration includes a compensation space being sealed between said cylinder space bounding said larger piston area and said connecting space bounding said smaller piston area, said compensation space being connected to said low-pressure space.

7. The hydraulic device according to claim 4, wherein said piston/cylinder configuration includes a compensation space being sealed between said cylinder space bounding said larger piston area and said connecting space bounding said smaller piston area, said compensation space being connected to said low-pressure space.

8. The hydraulic device according to claim 4, including a contact surface for said piston being associated with said cylinder space, said contact surface being adjustable for adjusting a path traversed by said piston.

* * * * *